US006866068B2

(12) United States Patent
Berger et al.

(10) Patent No.: US 6,866,068 B2
(45) Date of Patent: Mar. 15, 2005

(54) METHOD FOR PRODUCING WOVEN FABRICS

(75) Inventors: Johann Berger, Alfdorf (DE); Holger Saint-Denis, Rheinfelden (DE)

(73) Assignee: Berger Seiba-Technotex Verwaltungs GmbH & Co., Bad Sackingen (DE)

( * ) Notice: Subject to any disclaimer, the term of this patent is extended or adjusted under 35 U.S.C. 154(b) by 0 days.

(21) Appl. No.: 10/102,266

(22) Filed: Mar. 19, 2002

(65) Prior Publication Data

US 2002/0152594 A1 Oct. 24, 2002

Related U.S. Application Data

(63) Continuation of application No. PCT/EP00/09300, filed on Mar. 29, 2001.

(30) Foreign Application Priority Data

Sep. 24, 1999 (DE) ..... 199 45 880

(51) Int. Cl.[7] ..... D03D 15/04

(52) U.S. Cl. ..... 139/420 A; 139/426 R; 28/156; 442/208; 442/209

(58) Field of Search ..... 28/156; 139/420 A, 139/426 R; 442/208, 209

(56) References Cited

U.S. PATENT DOCUMENTS

| | | | | | |
|---|---|---|---|---|---|
| 4,425,946 | A | * | 1/1984 | McGinley | 139/460 |
| 5,858,885 | A | * | 1/1999 | Hamilton et al. | 442/184 |
| 5,994,243 | A | * | 11/1999 | Bowen et al. | 442/203 |
| 6,455,449 | B1 | * | 9/2002 | Veiga et al. | 442/218 |

* cited by examiner

*Primary Examiner*—John J. Calvert
*Assistant Examiner*—Robert H. Muromoto
(74) *Attorney, Agent, or Firm*—Harness, Dickey & Pierce, P.L.C.

(57) ABSTRACT

A method for producing woven fabrics, especially airbag woven fabrics, while using a multiphase weaving machine in the following steps: weaving a fabric comprised of filament threads in warp and weft on the multiphase weaving machine, whereby a high shrinking type of yarn is used as the warp and an average to low shrinking type of yarn is used as the weft, and finishing the woven fabric by hydroshrinking and/or thermoshrinking.

30 Claims, No Drawings

METHOD FOR PRODUCING WOVEN FABRICS

BACKGROUND AND SUMMARY OF THE INVENTION

The present invention relates to a method for producing woven fabrics, more particularly airbag woven fabrics in making use of a multiphase or series shed weaving machine.

Known from WO 96/38 610 is, for example, a series shed weaving machine with weaving rotor featuring insertion and beating-up reeds. The insertion reeds serve at a periphery to reed warp threads from an insertion station up to a beat-up in the form of sheds when weft threads are fed into the sheds from a weft thread conditioner. The beating-up reeds serve to beat up the picked wefts at the beat-up of the formed woven. With this technology a particularly uniform enlacing of the two warp and weft thread systems is achievable in thus enabling the physical properties of the woven to be equalized over the width of the woven web in avoiding a left/middle/right effect. Although with the simultaneous pick of, for example, up to four weft threads a very high pick capacity of up to 5000 meters per minute materializes in achieving cost-effective weaving at extremely high speed, the material produced on a series shed weaving machine is a woven of less density mechanically.

It is thus an object of the invention to propose a method for producing woven fabrics in making use of a multiphase or series shed weaving machine suitable in density for use as an airbag woven, as well as the woven fabric itself. This objective is achieved by a method as it reads from claim 1. This results in the advantage that in making use of a high-shrinkage type of yarn in the warp direction in the finishing process by hydro- and/or thermoshrinkage the weft density is simultaneous increased. When use is made of a medium to low shrinkage type of yarn as the weft material the shrinking motion in hydro- and/or thermoshrinkage occurs at the binding points asymmetrically such that as a result the finished woven comprises symmetrical thread densities in weft and warp in accordingly featuring in addition to air permeability also the remaining physical properties—the same as the conventionally produced woven—in both thread directions. From a raw woven fabric woven asymmetrically due to the system of the series shed weaving machine a symmetrically structured textile surface area is achieved by finishing which satisfies the density and symmetry requirements of airbag wovens.

The method as set forth in claim 1 is further sophisticated to advantage in that filament yarns having 8–14% and 1–5% hot air shrinkage are used as warp and weft respectively. Making use of these types of yarn results in an end product of exceptionally homogenous weave particularly suitable for use in airbags.

DETAILED DESCRIPTION

For a better understanding of the invention the method of production will now be explained by way of example.

The woven consisting of filament threads in weft and warp is produced in accordance with the weaving concept on a multiphase or series shed weaving machine as evident from WO 96/38 610. The pick is done in a series of four sheds by air nozzles all at the same speed and thus free of any tension peaks. The staggered picks are guided in the weft channel by the rotor movement at the selvedge where the emerging undershed lifts the partly enlaced weft threads over the full weaving width from the weft channel and is beaten up by each subsequent beating-up reed. To attain the density as required in the end product it is proposed in accordance with the invention to select weft and warp in combination with hydro- and thermoshrinkage during finishing to achieve a woven quality suitable for use as an airbag woven.

By controlled selection of a high-shrinkage type of yarn in the warp direction and a medium to low shrinkage type of yarn in the weft direction in accordance with the invention the asymmetrically woven fabric is formed in the finishing process into a symmetrical woven due to the asymmetrical shrinkage actions in the end product. The shrinking movements occuring in finishing at the binding points occur asymmetrically with the result that the finished woven features symmetrical weft and warp thread densities in accordingly comprising in addition to air permeability also the remaining physical properties in both thread directions in thus producing from an asymmetrically woven raw fabric a symmetrical structured textile surface area in finishing. To advantage and without exceeding the mechanically physical limits in stressing the yarn (tearing force) the pick capacity is more than doubled as compared to shank weave technology with air nozzle picking in avoiding the disadvantages thereof of the less dense weft threads since the lack of uniformity in finishing is now eliminated as explained above.

In summary by means of the method in accordance with the invention it is now also possible to produce on a modern series shed weaving machine a uniform woven suitable for use in airbags whilst fully exploiting the advantagess made available by the shed course weaving method.

What is claimed is:

1. A method for producing woven fabrics making use of a multiphase weaving machine comprising the steps a) weaving a fabric comprised of filament threads in weft and warp on the multiphase weaving machine, wherein a high-shrinkage type of yarn is used as the warp and a medium to low shrinkage type of yarn is used as the weft; and b) finishing the woven by shrinking, the low density threads more than the higher density threads after weaving.

2. The method as set forth in claim 1, wherein filament yarns having 8–14% and 1–5% hot air shrinkage are used as warp and weft respectively.

3. The method of claim 1, further comprising the steps of forming an airbag of the woven fabric, and changing a substantially asymmetrical nature of the woven fabric to a substantially symmetrical nature of the woven fabric.

4. The method as set forth in claim 1, wherein said step of finishing comprises hydro-shrinking the woven.

5. The method as set forth in claim 1, wherein said step of finishing comprises thermo-shrinking the woven.

6. A method for producing woven fabrics comprising the steps of:

a) weaving a fabric comprised of filament threads in weft and warp, wherein a high-shrinkage type of yarn is used as the warp and a medium to low shrinkage type of yarn is used as the weft; and b) finishing the woven by shrinking the lower density threads more than the higher density threads after weaving.

7. The method as set forth in claim 6, wherein filament yarns having 8–14% and 1–5% hot air shrinkage are used as warp and weft respectively.

8. The method of claim 6 further comprising the steps of forming an airbag of the woven fabric, and changing a substantially asymmetrical nature of the woven fabric to a substantially symmetrical nature of the woven fabric.

9. The method as set forth in claim 6, wherein said step of finishing comprises hydro-shrinking said woven.

10. The method as set forth in claim 6, wherein said step of finishing comprises thermo-shrinking said woven.

11. A method of producing a woven fabric, the method comprising:

weaving a fabric from filament threads in warp and weft so that an asymmetric thread density fabric is produced, said warp filament thread being a higher-shrinkage yarn than said weft filament thread; and shrinking the lower density threads more than the higher density threads after weaving said asymmetric thread density fabric so that a generally predetermined thread density fabric is produced.

12. The method of claim 11, wherein said step of shrinking comprises shrinking said asymmetric thread density fabric so that a generally symmetric thread density fabric is produced.

13. The method of claim 11, wherein the predetermined thread density fabric is part of an airbag.

14. The method of claim 11, wherein:

said warp yarn is a high-shrinkage type of yarn; and said weft yarn is a medium to low-shrinkage type of yarn.

15. The method of claim 14, wherein:

said warp yarn is an 8–14% hot air shrinkage yarn; and said weft yarn is a 1–5% hot air shrinkage yarn.

16. The method of claim 11, wherein said step of shrinking comprises hydro-shrinking said asymmetric thread density fabric.

17. The method of claim 11, wherein said step of shrinking comprises thermo-shrinking said asymmetric thread density fabric.

18. The method of claim 11, wherein said step of shrinking comprises hydro-shrinking and thermo-shrinking said asymmetric thread density fabric.

19. The method of claim 11, wherein said step of weaving comprises weaving said fabric on a multiphase weaving machine.

20. The method of claim 11, wherein said step of weaving comprises weaving said fabric on a series shed weaving machine.

21. A method for producing woven fabrics with irreversible shrinkable filament warp and weft yarns, in making use of a multiphase weaving machine, the method comprising:

(a) weaving a fabric of filament threads in weft and warp on the multiphase weaving machine, wherein a high-shrinkage type of yarn is used as the warp and a medium-to-low shrinkage type of yarn is used as the weft; and (b) finishing the woven by shrinking the lower density threads more than the higher density threads after weaving.

22. The method of claim 21, wherein the fabric is part of an airbag.

23. A method for producing airbag woven fabrics, in making use of a multiphase weaving machine, the method comprising:

(a) weaving a fabric of filament threads in weft and warp on the multiphase weaving machine, wherein a high-shrinkage type of yarn is used as the warp and a medium-to-low shrinkage type of yarn is used as the weft; and (b) finishing the woven by shrinking the lower density threads more than the higher density threads after weaving.

24. A method of manufacturing a product, the method comprising:

(a) weaving an asymmetrical thread density fabric on a multiphase weaving machine by using a high-shrinkage type of warp yarn and a medium-to-low shrinkage type of weft yarn;

(b) finishing the woven by shrinking the lower density threads more than the higher density threads after weaving the asymmetric thread density fabric to create a substantially symmetrical thread density in the fabric; and (c) creating an airbag from the finished fabric.

25. The method of claim 24, wherein:

the warp yarn is an 8–14% hot air shrinkage yarn; and the weft yarn is a 1–5% hot air shrinkage yarn.

26. The method of claim 24, wherein the step of shrinking comprises hydro-shrinking the asymmetric thread density fabric.

27. The method of claim 24, wherein the step of shrinking comprises thermo-shrinking the asymmetric thread density fabric.

28. The method of claim 24, wherein the step of shrinking comprises hydro-shrinking and thermo-shrinking the asymmetric thread density fabric.

29. The method of claim 24, wherein the step of weaving comprises weaving the fabric on a series shed weaving machine.

30. A method of manufacturing a product, the method comprising:

(a) weaving a fabric with higher density threads in a first direction and lower density threads in substantially perpendicular second direction;

(b) shrinking the lower density more than the higher density threads after weaving;

(c) causing the fabric to have substantially the same density in the first and second directions after the shrinking; and (d) creating an inflatable safety device from the shrunk and woven fabric.

* * * * *